US008606153B2

(12) United States Patent
Hiratsuka et al.

(10) Patent No.: US 8,606,153 B2
(45) Date of Patent: Dec. 10, 2013

(54) IMAGE FORMING APPARATUS WITH CONVEYING BELT POSITION DETECTION AND CORRECTION

(75) Inventors: Takashi Hiratsuka, Tokorozawa (JP); Shinji Yamamoto, Kawasaki (JP); Yasumi Yoshida, Yokohama (JP); Toshihiro Fukasaka, Kawasaki (JP); Tadashi Matsumoto, Tokyo (JP); Sumitoshi Sotome, Yachiyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 312 days.

(21) Appl. No.: 13/030,589

(22) Filed: Feb. 18, 2011

(65) Prior Publication Data

US 2011/0206392 A1 Aug. 25, 2011

(30) Foreign Application Priority Data

Feb. 23, 2010 (JP) ..... 2010-037528

(51) Int. Cl.
*G03G 15/01* (2006.01)

(52) U.S. Cl.
USPC ..... 399/302

(58) Field of Classification Search
USPC ..... 399/162, 165, 167, 302, 303, 308
See application file for complete search history.

(56) References Cited

U.S. PATENT DOCUMENTS

| | | | | |
|---|---|---|---|---|
| 5,217,532 | A | 6/1993 | Sasame et al. | |
| 5,500,726 | A | 3/1996 | Aoyama et al. | |
| 5,681,036 | A | 10/1997 | Wakahara et al. | |
| 6,871,036 | B2 * | 3/2005 | Asuwa et al. | 399/302 |
| 2006/0215008 | A1 | 9/2006 | Kibayashi | |
| 2010/0117289 | A1 | 5/2010 | Takahashi et al. | |
| 2010/0128079 | A1 | 5/2010 | Matsumoto | |

FOREIGN PATENT DOCUMENTS

| | | | |
|---|---|---|---|
| CN | 101493670 | A | 7/2009 |
| JP | 2000-34031 | A | 2/2000 |
| JP | 2000-233843 | A | 8/2000 |
| JP | 2003-312885 | A | 11/2003 |
| JP | 2006-264934 | A | 10/2006 |

OTHER PUBLICATIONS

Notification of the First Office Action, dated Apr. 3, 2013, issued by the State Intellectual Property Office of the People's Republic of China, in Chinese Patent Application No. 201110044257.3.

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes a rotatable belt member; an image forming station; first and second detecting members for detecting widthwise positions of the belt member; first and second steering rollers for correcting the widthwise positions of the belt member by inclination; a control portion configured to control inclinations of the first and second steering rollers on the basis of an output of the first or second detecting member; a first executing portion configured to execute, in a period other than an image formation period, an operation in a correction mode of, in a state that the first steering roller is at a first reference inclination, controlling the second steering roller to correct a second reference inclination of the second steering roller; and a second executing portion configured to execute, in a period other than that of the correction mode operation, an operation in a control mode of controlling the first and second steering rollers on the basis of the first and second reference inclinations.

7 Claims, 12 Drawing Sheets

(a)

(b)

IMAGE FORMING APPARATUS WITH CONVEYING BELT POSITION DETECTION AND CORRECTION

FIELD OF THE INVENTION AND RELATED ART

The present invention relates to an image forming apparatus which corrects its rotational belt in the positional deviation in the widthwise direction of the belt, by tilting its multiple steering rollers while the belt is being rotated. More specifically, it relates to an image forming apparatus which controls its belt unit in such a manner that the belt is minimized in the amount of the stress attributable to the correction of the belt in position by the multiple steering rollers in terms of the widthwise direction of the belt.

An image forming apparatus which corrects its intermediary transfer belt and/or recording medium conveyance belt, in the positional deviation in the widthwise direction of the belt, by tilting its steering roller while the belt is being rotated, has been in practical usage. There has been also put into practical usage an image forming apparatus which forms a full-color image on recording medium by forming multiple monochromatic toner images, different in color, on its multiple image bearing members, one for one, and layering the multiple monochromatic toner images on the recording medium, with the use of these belts which are controlled in their position in their widthwise direction by one or more steering rollers (Japanese Laid-open Patent Application 2000-34031).

Japanese Laid-open Patent Application 2000-34031 discloses an image forming apparatus which has a belt edge detecting means and a steering roller. In terms of the moving direction of its belt, the belt edge detecting means and steering roller are on the downstream side of the area in which the belt contacts the image bearing members of the apparatus. This image forming apparatus is structured so that its belt remains in a preset position relative to the main assembly of the apparatus, in terms of the axial direction of the steering roller. More specifically, as the belt deviates in position in the axial direction of the steering roller, it is corrected in position in terms of the widthwise direction of the steering roller, by tilting the steering roller by an amount proportional to the output of the belt edge detecting means.

Japanese Laid-open Patent Application 2000-233843 discloses an image forming apparatus which has two steering rollers. One is similar to the steering roller of the image forming apparatus disclosed in Japanese Laid-open Patent Application 2000-34031. Another one is for correcting the belt in angle, since it is virtually impossible to correct the belt in angle with the use of only one steering roller. More specifically, in the case of the image forming apparatus disclosed in Japanese Laid-open Patent Application 2000-233843, two (first and second) detecting means are provided, which are positioned so that they sandwich the area in which the belt is in contact with the image bearing members, in terms of the moving direction of the belt. The difference in output between the two detecting means is used as the unwanted amount of skewness of the belt. As it is detected that the belt has deviated in position in its widthwise direction, the first steering roller is tilted to prevent the belt from shifting further in its widthwise direction, and then, the second steering roller is controlled to correct the belt in angle.

Even in the case of a belt unit which is correct in design and has been highly precisely assembled from highly precisely processed components, as the belt of the belt unit is rotated, it is subjected to a small amount of force which works in the widthwise direction of the belt. More specifically, even if a belt unit is free of this force at the point of shipment, it ends up generating this force, although by only a small amount, because of the temperature increase attributable to the operation of the image forming apparatus, the frame deformation resulting from the temperature increase, the mechanical wear resulting from apparatus usage, and/or the like. Therefore, if a belt unit which employs multiple steering rollers is controlled in belt steer roller angle without the detection of which roller or rollers are responsible for this small amount of force, it is unlikely for the belt to be reliably controlled in position in terms of its widthwise direction.

SUMMARY OF THE INVENTION

An image forming apparatus in accordance with the present invention controls its second steering roller to allow its first steering roller to restore itself in angle in such a manner that the central value of the range of angle in which the first steering roller is tilted converges to a preset value. Therefore, it does not occur that the first steering roller is tilted by an angle large enough to make the center value of the range of angle of the first steering roller significantly different from the preset value. Therefore, the belt of the apparatus is not going to be subjected to an excessive amount of stress.

Therefore, not only is the image forming apparatus in accordance with the present invention significantly smaller in the unnecessary amount of force which works on the belt in the widthwise direction of the belt, being therefore significantly more precise and higher in reproducibility in terms of the control of the steering roller, than any image forming apparatus in accordance with the prior arts, but also, it is significantly higher in the accuracy with which the circularly movable belt is kept precisely positioned in the widthwise direction of the belt, than any image forming apparatus in accordance with the prior arts.

According to an aspect of the present invention, there is provided an image forming apparatus comprising a rotatable belt member; an image forming station for forming an image on said belt member or a recording material carried on said belt member in a region opposing said belt member; first detecting means for detecting a position of said belt member with respect to a widthwise direction of said belt member; a first steering roller for correcting the position of said belt member with respect to the widthwise direction by inclination; first control means for controlling an inclination of first steering roller on the basis of an output of said first detecting means; second detecting means for detecting the position of said belt member with respect to the widthwise direction; a second steering roller for correcting the position of said belt member with respect to the widthwise direction by inclination; calculating means for calculating such an amount of inclination of said second steering roller that a movement distance of said belt member in the widthwise direction is not more than a predetermined value in a state that an inclination of first steering roller is set to a predetermined value; and second control means for controlling the inclination of said second steering roller in accordance with an output of said second detecting means with the amount of inclination calculated by said calculating means being a median value.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings. Not only is the present invention applicable to the image forming apparatuses in the following preferred embodiments, but also, any image forming apparatus which equally reproduces the central value of the angular range in which the first steering roller is tilted, by tilting the second steering roller, even if the apparatus is partially or entirely different in structure from the image forming apparatuses in the following preferred embodiment.

In other words, the present invention is applicable to any image forming apparatus which employs a belt which is controlled in position by a steering means, regardless of whether the apparatus is of the tandem type, or the single drum type, or whether the apparatus is of the intermediary transfer type or direct transfer type. In the following description of the preferred embodiments of the present invention, it is only the portions of the image forming apparatuses, which are essential to the formation and transfer of a toner image, that are described. However, the present invention is also applicable to various image forming apparatuses other than those in the preferred embodiments. That is, the present invention is applicable to a copying machine, a facsimile machine, a multifunction image forming apparatus capable of functioning as two or more of the preceding image forming apparatuses, which comprise devices, equipments, external shells, etc., other than those in the preferred embodiments, in addition to those in the preferred embodiments.

<Image Forming Apparatus>

Figure 1:
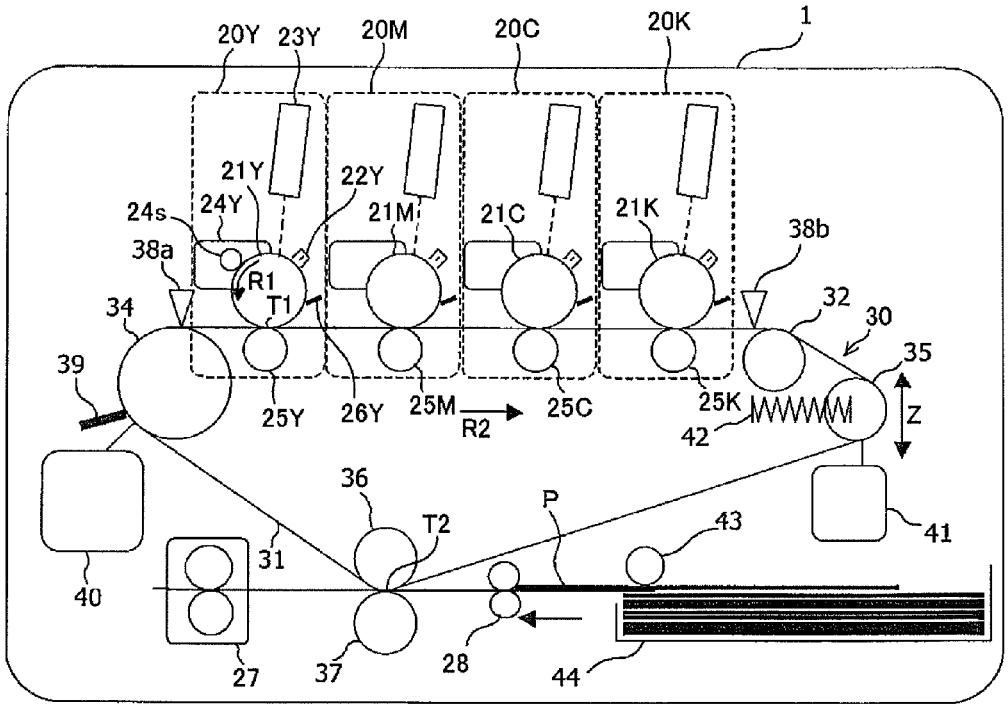
FIG. 1 is a schematic sectional view of the image forming apparatus in the first preferred embodiment of the present invention, and depicts the structure of the apparatus.

FIG. 1 is a schematic sectional view of the image forming apparatus in the first preferred embodiment of the present invention, and depicts the structure of the apparatus. Referring to FIG. 1, the image forming apparatus 1 is a full-color printer of the tandem-type, and also, of the intermediary transfer type. That is, the image forming apparatus 1 has an intermediary transfer belt 31, and yellow, magenta, cyan, and black image forming portions 20Y, 20M, 20C, and 20K, respectively. The four image forming portions 20Y, 20M, 20C and 20K are sequentially positioned in parallel in the adjacencies of intermediary transfer belt 31.

In the image forming portion 20Y, a yellow toner image is formed on a photosensitive drum 21Y, and is transferred (first transfer) onto the intermediary transfer belt 31. In the image forming portion 20M, a magenta toner image is formed on a photosensitive drum 21M, and is transferred (first transfer) onto the intermediary transfer belt 31 in such a manner that it is layered upon the yellow toner image on the intermediary transfer belt 31. In the image forming portion 20C, a cyan toner image is formed on a photosensitive drum 21C, and is transferred (first transfer) onto the intermediary transfer belt 31 in such a manner that it is layered on the yellow and magenta toner images on the intermediary transfer belt 31. In the image forming portion 20K, a black toner image is formed on a photosensitive drum 21K, and is transferred (first transfer) onto the intermediary transfer belt 31 in such a manner that it is layered on the yellow, magenta, and cyan images on the intermediary transfer belt 31.

The layered four monochromatic toner images, different in color, on the intermediary transfer belt 31 are conveyed to a second transfer portion T2, and are transferred together (second transfer) onto a sheet P of recording medium in the second transfer portion T2. After the transfer of the layered four monochromatic images, that is, a full-color toner image made up of four monochromatic toner images different in color, onto the sheet P of recording medium, the sheet P is separated from the intermediary transfer belt 31 with the utilization of the curvature which the intermediary transfer belt 31 forms, and is sent into a fixing apparatus 27. The fixing apparatus 27 fixes the layered four monochromatic toner images on the sheet P to the surface of the sheet P by the application of heat and pressure. Thereafter, the sheet P is discharged from the image forming apparatus 1.

The image forming apparatuses 20Y, 20M, 20C, and 20K are virtually the same in structure, although they are different in that they use developing apparatuses 24Y, 24M, 24C, and 24K, which use yellow, magenta, cyan, and black toners, respectively. Hereafter, therefore, only the yellow image forming portion 20Y is described, since the descriptions of the other image forming portions 20M, 20C, and 20K are the same as that of the yellow image forming portion 20Y except for the suffix Y of the referential codes for the structural components, which has to be replaced with M, C, and K, respectively.

The image forming portion 20Y has a photosensitive drum 21Y. It has also a charging device 22Y of the corona-type, an exposing apparatus 23Y, a developing apparatus 24Y, a first transfer roller 25Y, and a drum cleaning apparatus 26Y, which are in the adjacencies of the peripheral surface of the photosensitive drum 21Y.

The photosensitive drum 21Y has a photosensitive surface layer which is negatively chargeable. It is rotated in the direction indicated by an arrow mark R1 at a process speed of 300 mm/sec. The charging device 22Y of the corona-type negatively charges the peripheral surface of the photosensitive drum 21Y to a preset level (pre-exposure potential level VD) by discharging charged electrical particles (corona). The exposing apparatus 23Y writes an electrostatic image on the peripheral surface of the photosensitive drum 21Y by scanning the charged portion of the peripheral surface of the photosensitive drum 21Y with the beam of laser light which it projects upon its rotating mirror while modulating (turning on and off) the beam of laser light according to the image formation data obtained by developing the data of the yellow monochromatic image obtained by separating the image to be formed, into monochromatic images.

The developing apparatus 24Y charges two-component developer made up of nonmagnetic toner and magnetic carrier, and conveys the charged two-component developer to the interface between the peripheral surface of its development sleeve 24*s* and the peripheral surface of the photosensitive drum 21Y, by causing the charged two-component developer to be borne on the peripheral surface of the development sleeve 24*s*. To the development sleeve 24*s*, an oscillatory voltage, which is a combination of a DC voltage and an AC voltage, is applied, whereby the negatively charged nonmagnetic toner on the peripheral surface of the development sleeve 24*s* is made to transfer onto the exposed portions of the peripheral surface of the photosensitive drum 21Y, which have been made positively charged relative to the potential level of the negatively charged toner, by the exposure. That is, the electrostatic image on the peripheral surface of the photosensitive drum 21Y is developed in reverse.

The first transfer roller 25Y forms the first transfer portion T1 between the outward surface (with reference to the loop which the intermediary transfer belt 31 forms) of the intermediary transfer belt 31 and the peripheral surface of the photosensitive drum 21Y, by pressing on the inward surface of the intermediary transfer belt 31. As a positive voltage is applied to the first transfer roller 25Y, the toner image formed on the peripheral surface of the photosensitive drum 21Y is transferred (first transfer) onto the intermediary transfer belt 31. The drum cleaning apparatus 26Y recovers the toner (transfer residual toner) remaining on the peripheral surface of the photosensitive drum 21Y after the first transfer, by rubbing the peripheral surface of the photosensitive drum 21Y with its cleaning blade.

The second transfer roller 37 forms the second transfer portion T2 by being placed in contact with the portion of the intermediary transfer belt 31, which is supported by a belt supporting roller 36, from within the inward side of the belt loop. A recording sheet cassette 44 holds multiple sheets P of recording medium. Each sheet P of recording medium in the cassette 44 is fed into the main assembly of the image forming apparatus 1 by a separation roller 43 while being separated from the rest of the sheets P of recording medium in the cassette 44. Then, it is sent to a pair of registration rollers 28, which catches the sheet P, while remaining stationary, and keeps the sheet P on standby. Then, the pair of registration rollers 28 release the sheet P with such timing that the sheet P and the toner image on the intermediary transfer belt 31 arrive at the second transfer portion T2 at the same time.

While the full-color toner image, that is, the layered four monochromatic toner images, different in color, on the intermediary transfer belt 31, and the sheet P of recording medium, are conveyed through the second transfer portion T2, remaining pinched together between the intermediary transfer belt 31 and second transfer roller 37, a positive DC voltage is applied to the second transfer roller 37, whereby the full-color toner image is transferred (second transfer) from the intermediary transfer belt 31 onto the sheet P of recording medium. As for the toner (transfer residual toner) remaining on the surface of the intermediary transfer belt 31, that is, the toner on the surface of the intermediary transfer belt 31, which was not transferred onto the sheet P, it is recovered by the belt cleaning apparatus 39.

A belt unit 30 is made up of the intermediary transfer belt 31, and a set of four rollers, more specifically, a driver roller 34, a follower roller 32, a steering roller 35, and the belt backing roller 36, by which the intermediary transfer belt 31 is supported and kept stretched. The intermediary transfer belt 31 is rotated by the driver roller 34 in the direction indicated by an arrow mark R2 at a process speed of 300 mm/sec. The main assembly of the image forming apparatus is structured so that the belt unit 30 can be replaced along with the aforementioned first transfer rollers 25 (25Y, 25M, 25C, and 25K).

The steering roller 35 can be tilted. Further, it is under the pressure generated in the outward direction of the loop which the intermediary transfer belt 31 forms, by a pair of tension springs 42 which press on the lengthwise ends of the steering roller 35, one for one. Thus, the intermediary transfer belt 31 is provided with a preset amount of tension.

<Detecting Means>

Figure 2:
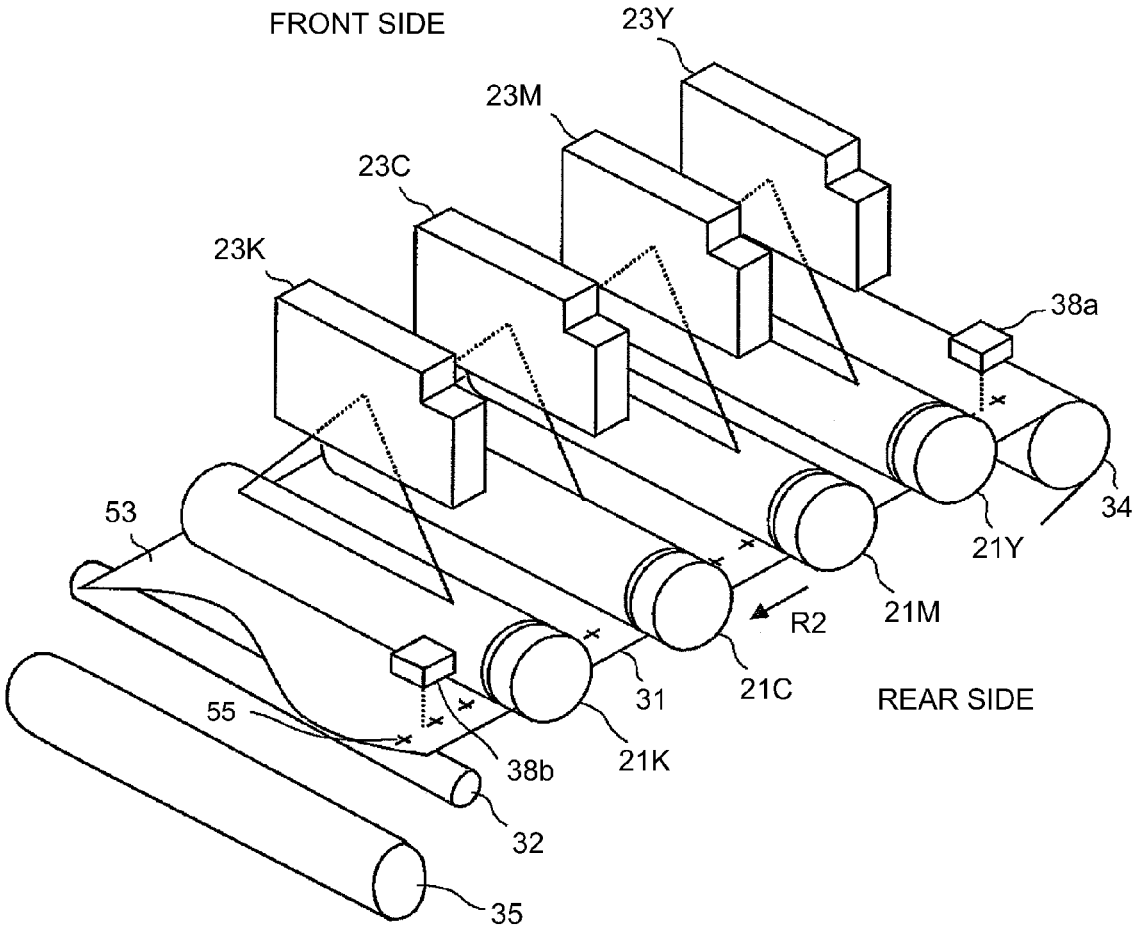
FIG. 2 is a schematic drawing for describing the positioning of the means used in the first preferred embodiment to detect the amount of positional deviation of the intermediary transfer belt in the widthwise direction of the belt, and the amount of angular deviation of the intermediary transfer belt.
Figure 3:
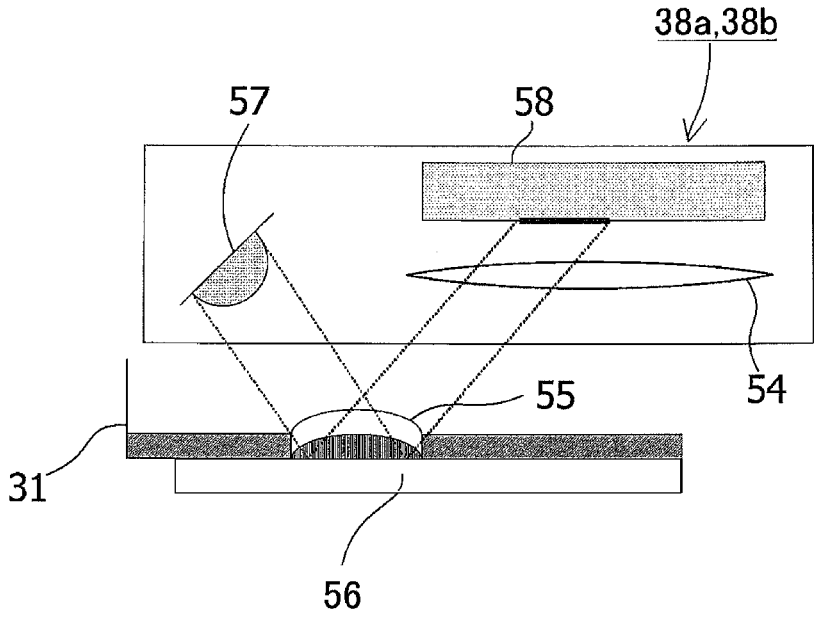
FIG. 3 is a schematic drawing for concretely describing the structure of the first and second sensors.

FIG. 2 is a schematic perspective view of the means used in the first preferred embodiment to detect the amount of the positional deviation of the intermediary transfer belt 31 in its widthwise direction, and the angle of the intermediary transfer belt 31, and the essential portions of the belt unit 30, and shows the positioning of the detecting means. FIG. 3 is a schematic drawing of the first and second sensors of the detecting means, shown in FIG. 2, and concretely shows the structure of the detecting means.

Referring to FIG. 2, the belt unit 30 is provided with a pair of sensors, that is, the second and first sensors 38*b* and 38*a*, respectively. In relation to the area in which the intermediary transfer belt 31 is in contact with the photosensitive drums 21Y, 21M, 21C, and 21K to allow toner images to be transferred (first transfer) from the photosensitive drums 21 onto the belt 31, the second sensor and first sensors 38*a* and 38*b* are on the downstream and upstream sides of the area, respectively, being aligned in the rotational direction of the belt 31, with the presence of a preset distance between the two sensors. Further, the second and first sensors 38*b* and 38*a* are positioned so that they face a first transfer surface 53, which the horizontal portion of the outward surface of the belt 31 forms between the top portion of the driver roller 34 and the top portion of the follower roller 32.

Since the second sensor 38*a* is in the downstream adjacencies of the driver roller 34, the amount of the positional deviation of the upstream end of the first transfer surface 53 of the intermediary transfer belt 31 can be reliably detected by the second sensor 38*a*, for the following reason. That is, the upstream edge of the first transfer surface 53 is the closest portion of the first transfer surface 53 to the driver roller 34 which supports the intermediary transfer belt 31. Therefore, it is the most rigid upstream portion of the first transfer surface 53.

Since the first sensor 38*b* is in the adjacencies of the follower roller 32, the amount of the positional deviation of the downstream end of the first transfer surface 53 can be reliably detected by the first sensor 38*b*, for the following reason. That is, the downstream edge of the first transfer surface 53 is the closest portion of the first transfer surface 53 to the steering roller 35, being therefore, the most rigid downstream portion of the first transfer surface 53.

Also because the second and first sensors 38*a* and 38*b* are in the adjacencies of the driver roller 34 and steering roller 35, respectively, there is a substantial distance between the second and first sensors 38*a* and 38*b*. Therefore, it is possible to accurately measure the amount of difference in output between the first and second sensors 38*b* and 38*a*, as an indicator of the amount of skewness (angle) of the intermediary transfer belt 31, which will be described later.

Referring to FIG. 3, the second and first sensors 38*a* and 38*b* are similar in structure, and detect the position of the intermediary transfer belt 31 in terms of the widthwise direction of the belt 31, at their own positions, by detecting patterns 55. Here, therefore, only the second sensor 38*a* is described; the first sensor 38*b* is not described in order not to repeat the same description.

The second sensor 38*a* which faces the intermediary transfer belt 31 has a light source 57 and a light sensing element 58. The light source 57 projects a beam of infrared light upon the intermediary transfer belt 31, and the light sensing element 58 detects the direct reflection of the beam of infrared light. More specifically, there is a reflective plate 56, which is on the opposite side of the belt 31 from the second sensor 38*a*. The second sensor 38*a* detects the beam of infrared light which is projected upon the reflective plate 56 through the patterns 55, is reflected by the plate 58, and reaches the light sensing element 58.

The light sensing element 58 is a two-dimensional area sensor (CCD) which is VGA in resolution. The second sensor 38*a* is provided with a lens 54, the properties of which are such that as an image of an object on the intermediary transfer belt 31 is projected upon the light sensing surface of the light sensing element 58 through the lens 54, it is magnified 10 times. In order to prevent the accuracy of the second sensor 38*a* from being affected by the movement of the intermediary transfer belt 31 in its rotational direction, a telecentric optical system, that is, an optical system, the optical axis of which is virtually parallel to principle ray, is used as the lens 54.

The outward surface of the intermediary transfer belt 31, in terms of the belt loop, is provided with belt position detection patterns 55, which are along one of the lateral edges of the intermediary transfer belt 31. The preciseness and shape of each pattern 55 are determined based on the information to be detected (obtained). It is desired that the patterns 55 directly reflect the amount of skewness of the intermediary transfer belt 31. Therefore, it is desired that the intermediary transfer belt 31 is manufactured so that the patterns 55 are precisely positioned on the intermediary transfer belt 31. More concretely, each pattern 55 is in the form of a round hole made through the intermediary transfer belt 31, as shown in FIG. 3, to make it possible for the sensors 38*a* and 38*b* to detect the light projected from the light source 57 and reflected by the reflective plate 56. The pattern 55 (hole) is 100 μm in diameter. In the first preferred embodiment, in order to improve the belt unit 30 in the preciseness with which the intermediary transfer belt 31 is circularly moved, the holes (patterns 55) which are 100 μm in diameter, were made with intervals of 5 mm during the manufacture of the intermediary transfer belt 31.

The pattern 55 does not need to be round. For example, the pattern 55 may be in the form of a cross printed on the intermediary transfer belt 31 as shown in FIG. 2. Further, the pattern may be precisely positioned during the manufacture of the intermediary transfer belt 31, or may be such an image that it is formed of toner, on one of the photosensitive drums, and then, is transferred onto the belt 31.

Also in the first preferred embodiment, two two-dimensional sensors (38*a* and 38*b*) are used, which are aligned in the rotational direction of the intermediary transfer belt 31 with the presence of a preset distance between the two sensors 38*a* and 38*b*. However, three or more sensors may be employed. Further, the detecting means does not need to be limited in selection to a CCD (two-dimensional area sensor). For example, a sensor of the contact type, which directly detects the belt edge, or a sensor which is different in the method of detection from a CCD, may be employed as the second sensors 38*a*.

<Steering Mechanism>

Figure 4:
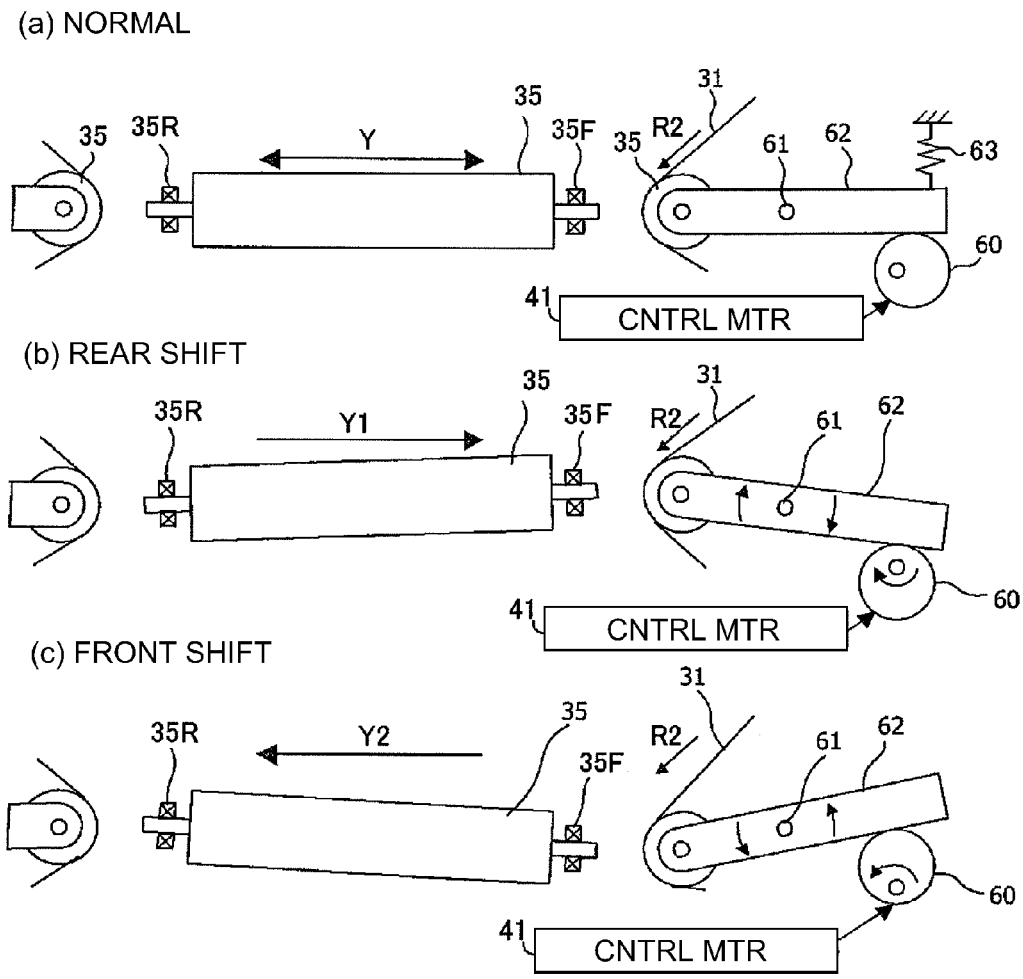
FIG. 4 is a schematic drawing for describing the operation of the steering mechanism.
Figure 5:
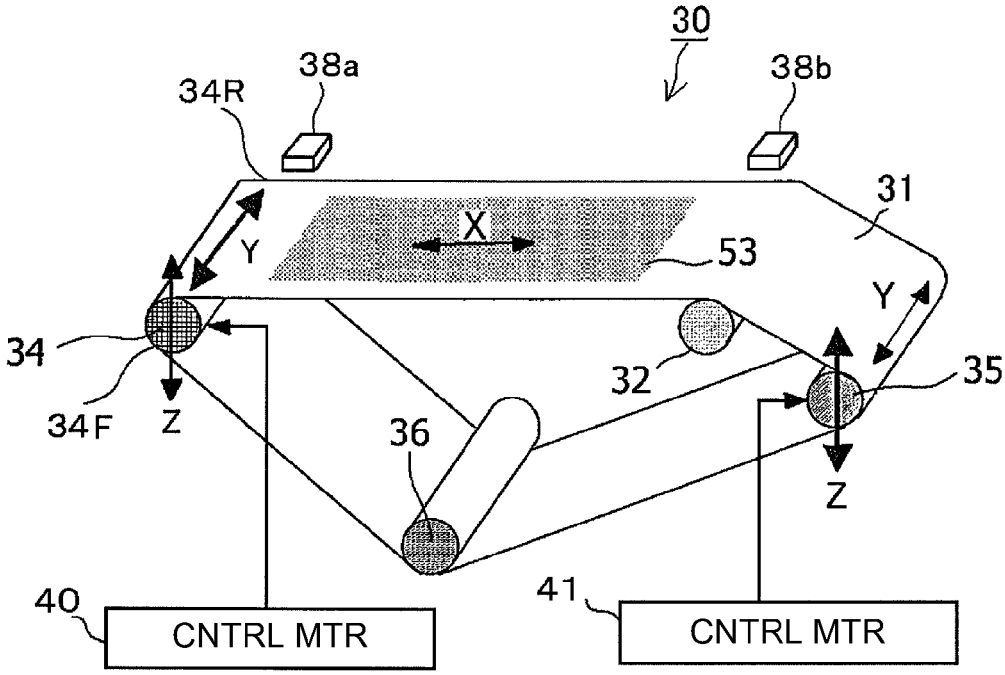
FIG. 5 is a schematic perspective view of the essential portions of the belt unit, and shows how the intermediary transfer belt 31 is provided with a preset amount of tension.

FIG. 4 is a schematic drawing for describing the operation of the steering mechanism. FIG. 5 is a schematic perspective view of the essential portions of the belt unit 30, and shows how the intermediary transfer belt 31 is provided with a preset amount of tension. The mechanism for tilting steering roller 35, which is an example of the first steering roller, and the mechanism for tilting the driver roller 34, which is an example of the second steering roller, are similar in structure. Hereafter, therefore, only the mechanism for tilting the steering roller 35 is described in order to not repeat virtually the same description.

Referring to FIG. 2, if the intermediary transfer belt 31 of the image forming apparatus 1 becomes askew during the aforementioned process for forming a multicolor image, monochromatic images, different in color, fail to be transferred in layers in perfect alignment relative to each other, onto the sheet P of recording medium. Thus, images which suffer from color deviation are outputted from the image forming apparatus 1. Therefore, in the case of the image forming apparatus 1, the amount of positional deviation of the intermediary transfer belt 31 in its widthwise direction is detected by the first sensor 38*b*, and then, the steering roller 35 is controlled (tilted) in such a manner that the belt 31 is moved in the opposite direction, in terms of its widthwise direction, from the direction of its positional deviation, by the amount equal to the detected amount of its positional deviation.

Next, the amount of skewness (angle) of the intermediary transfer belt 31 is detected by the first and second sensors 38*b* and 38*a*, and then, the driver roller 34 is controlled (moved) in such a manner that the belt 31 is rid of skewness to enable the image forming apparatus 1 to output high precision images, more specifically, images which do not suffer from color deviation.

Next, referring to FIG. 4(*a*), the belt unit 30 is structured so that the steering roller 35 can be tilted as if the rear end 35R of the roller 35 functions as the fulcrum for the tilting of the roller 35. More specifically, the belt unit 30 is provided with a steering roller control motor 41 and an eccentric cam 60. As the steering roller control motor 41 is driven, the eccentric cam 60 is rotated, whereby the steering roller 35 is tilted in such a direction that its front end 35F moves in the direction indicated by an arrow mark Z.

The angle by which the steering roller 35 is to be tilted is set according to the amount and direction of the positional deviation of the intermediary transfer belt 31, in terms of the widthwise direction of the belt 31, on the downstream side of the first transfer surface 53, which is detected by the first sensor 38*b* shown in FIG. 2. That is, it is on the downstream side of the first transfer surface 53 that the steering roller 35 can correct the positional deviation of the belt 31 in the widthwise direction of the belt 31 by controlling the snaking of the belt 31.

An oscillatory arm 62 is rotatably supported at its center by a fulcrum shaft 61. One of the lengthwise ends of the oscillatory arm 62 is in connection with the front end 35F of the steering roller 35 in such a manner that the steering roller 35 can be tilted while being rotated to drive the intermediary transfer roller 31. The other end of the oscillatory arm 62 is in connection with a spring 63 and is under the pressure from the spring 63, being therefore kept pressed upon the eccentric cam 60, which is in connection with the output shaft of the steering control motor 41.

Next, referring to FIG. 4(*b*), as the eccentric cam 60 is rotated in the CW (clockwise) direction by driving the steering control motor 41, the oscillatory arm 62 is tilted in the CW direction by the rotation of the oscillatory arm 62, whereby the steering roller 35 is tilted in such a direction that the front end 35F is moved in the upward direction (which is perpendicular to direction of belt tension). Consequently, the intermediary transfer belt 31 is moved in the direction indicated by an arrow mark Y1.

Next, referring to FIG. 4(*c*), as the eccentric cam 60 is rotated in the CCW (counterclockwise) direction by driving the steering control motor 41, the oscillatory arm 62 is tilted in the CCW direction by the rotation of the oscillatory arm 62, whereby the steering roller 35 is tilted in such a direction that the front end 35F is moved in the downward direction (which is perpendicular to direction of belt tension). Consequently, the intermediary transfer belt 31 is moved in the direction indicated by an arrow mark Y2.

Referring to FIG. 5, the driver roller 34 can be tilted as if its rear end 34R is functioning as the fulcrum for the tilting of the driver roller 34, in such a manner that its front end 34F moves upward or downward. That is, as the steering control motor 40 is driven, the driver roller 34 is tilted in such a manner that its front end 34F moves in the direction indicated by an arrow mark Z. The amount (angle) by which the driver roller 34 is to be tilted is set according to the speed with which the intermediary transfer belt 31 shifts in position in its widthwise direction, on the upstream side of the first transfer surface 53, and which is detected by the second sensor 38*a*. That is, the driver roller 34 corrects the belt 31 in position in terms of the widthwise direction of the belt 31, on the upstream side of the first transfer surface 53, by controlling the snaking of the belt 31.

A belt unit (30) which has two steering rollers (diver roller 34 and steering roller 35) can correct its belt (31) in angle regardless of the angle of the belt. This feature sometimes causes problems. That is, the belt (31) which provides the first transfer surface (53) is endless. Thus, the upstream end of the first transfer surface (53) is in indirect connection with the downstream end of the first transfer surface (53); they are in connection with each other through a plane (surface) to which the first transfer surface (53) does not belong. Thus, unless the belt (31), which is the target of control, is kept correct in angle, the belt (31) deforms across its portion which corresponds in position to the first transfer surface (53), or the like problems occur.

Therefore, in the first embodiment of the present invention, during the startup of the image forming apparatus, the apparatus is operated in the startup mode in which the belt (31) is relieved of an excessive amount of stress by a center value adjusting means (calculating means). Even though the belt (31) is relieved of the excessive amount of stress while the image forming apparatus is operated in the startup mode, stress will build up again in the belt as the ambient temperature of the belt increases due to the continuation of an image forming operation. Thus, the image forming apparatus is operated in the readjustment mode, which is an example of a modified version of the startup mode, with a preset frequency, in order to relieve the belt (31) of the excessive amount of stress. The frequency with which the apparatus is operated in the readjustment mode is gradually reduced with the elapse of time.

<Embodiment 1>

Figure 6:
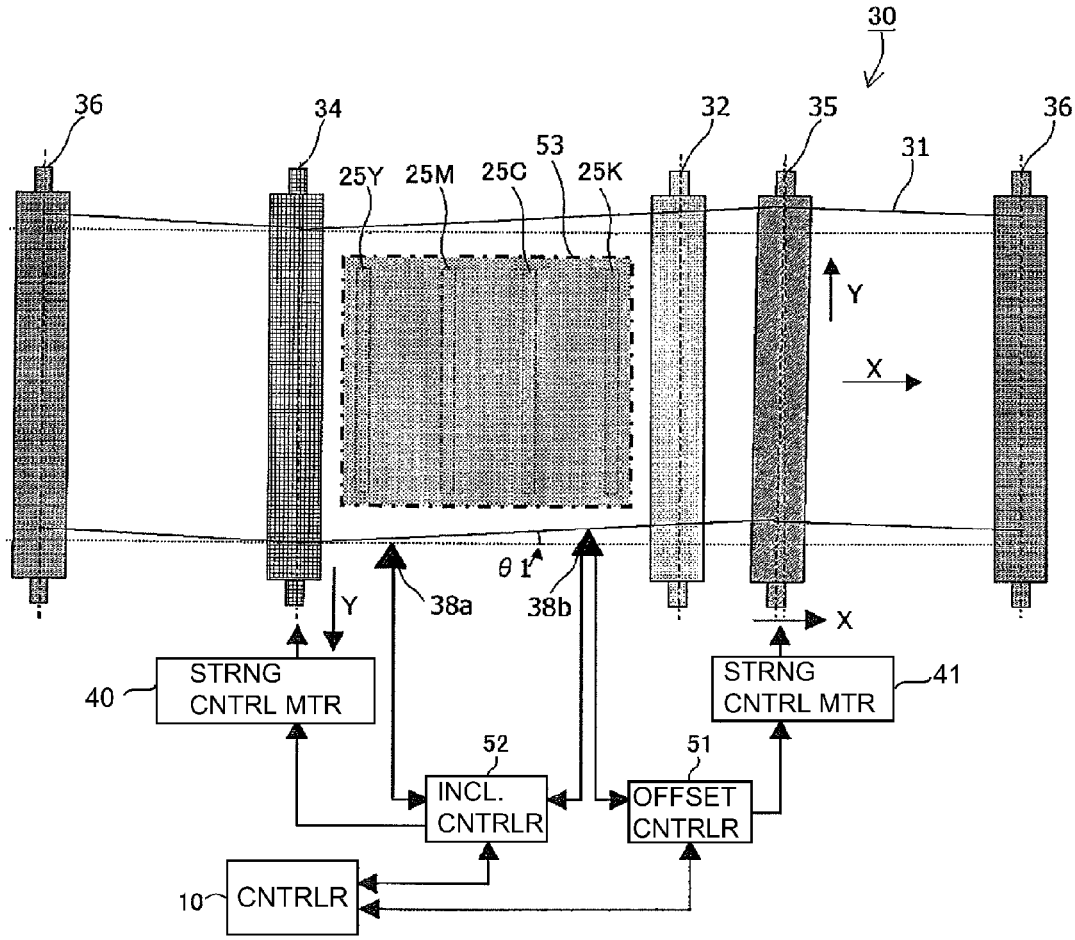
FIG. 6 is a combination of an extended drawing of the belt unit and a schematic diagram of the belt controlling mechanism, and shows the intermediary transfer belt when the belt is askew.
Figure 7:
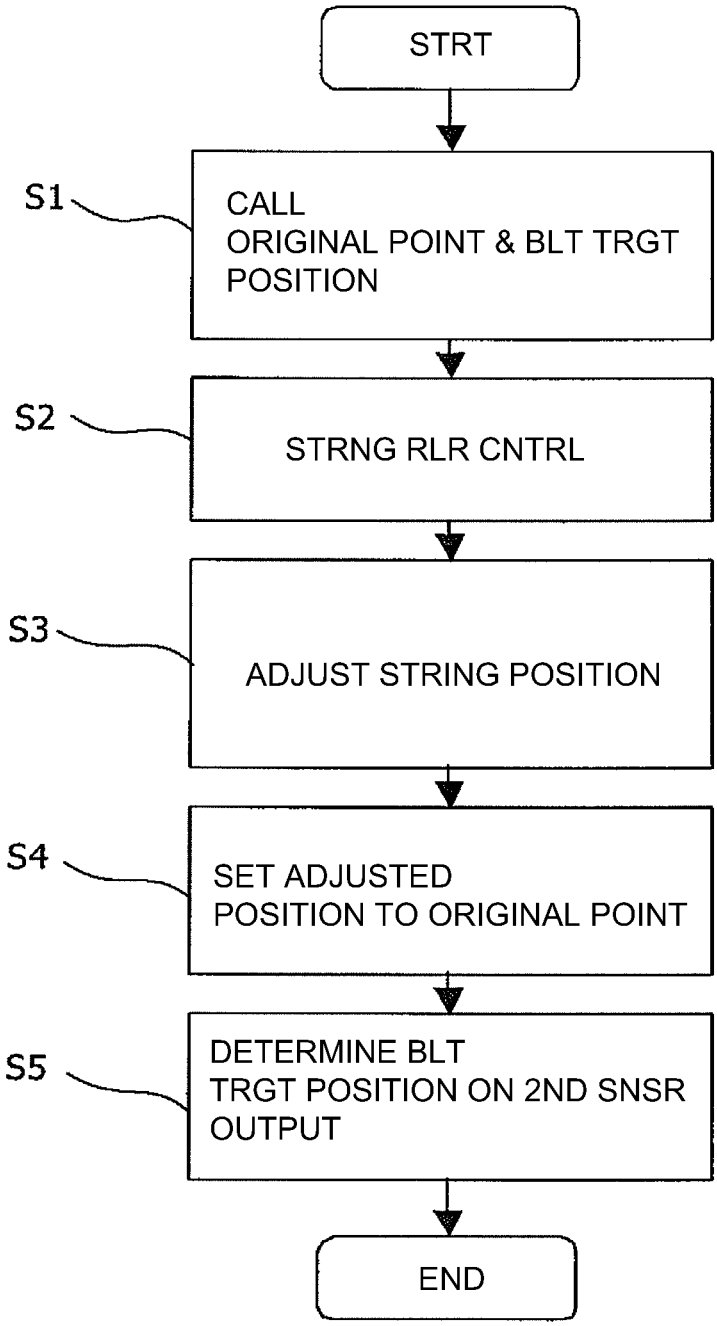
FIG. 7 is a flowchart of the control sequence in the startup mode for the image forming apparatus in the first embodiment.
Figure 8:
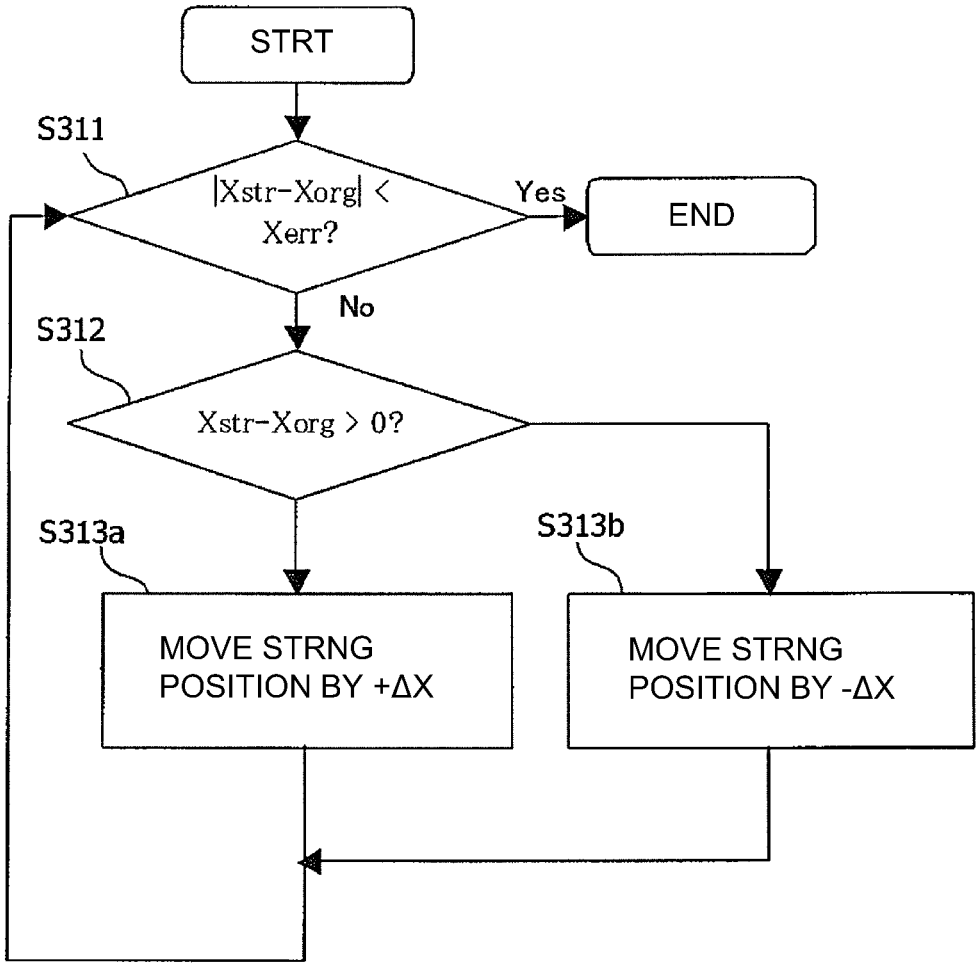
FIG. 8 is a flowchart of the control sequence for controlling the driver roller in angle in the startup mode in the first preferred embodiment.
Figure 9:
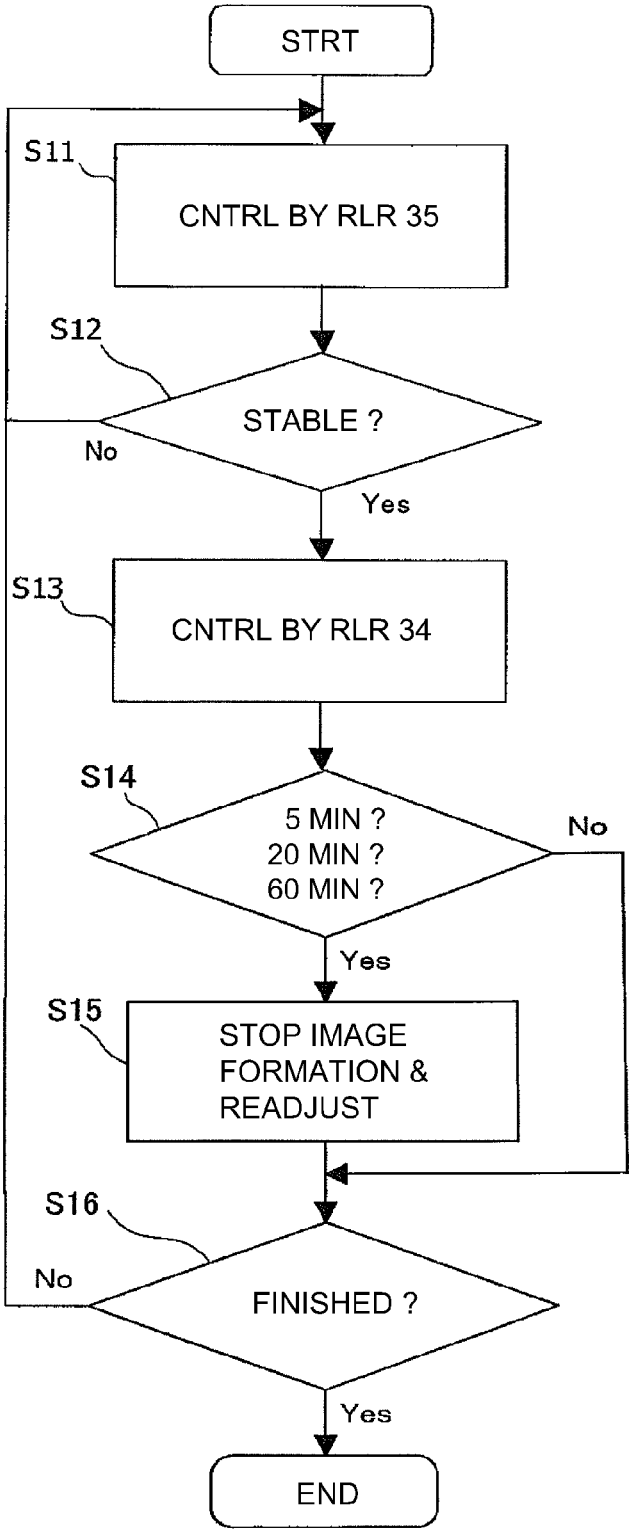
FIG. 9 is a flowchart of the control sequence for correcting the intermediary transfer belt in position in terms of its widthwise direction, and then, correcting the intermediary belt in angle.
Figure 10:
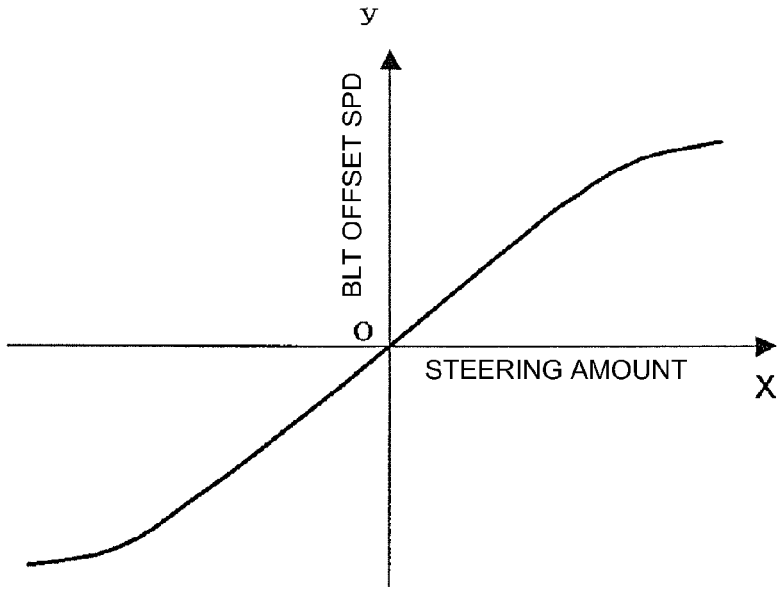
FIG. 10 is a graph for showing the relationship between the speed of the lateral shift of the intermediary transfer belt, and the amount of belt steering (steering roller angle), in the startup mode.
Figure 10:
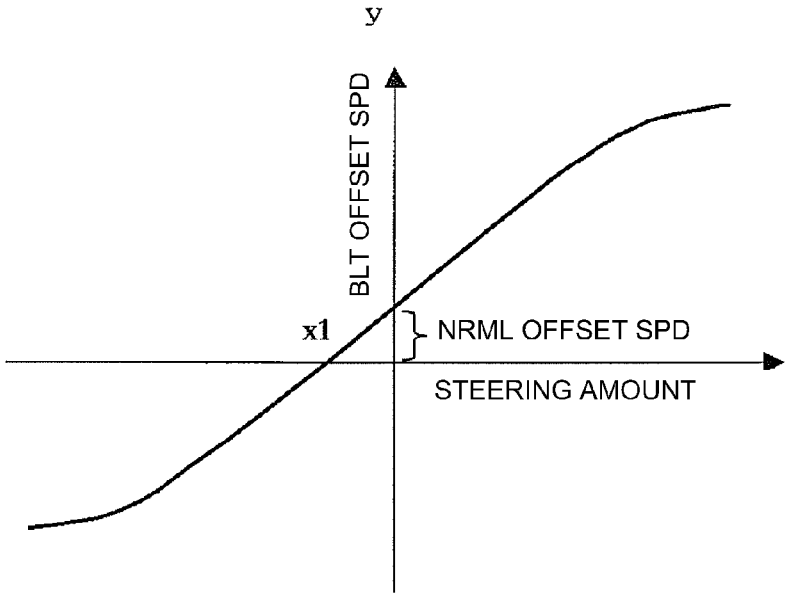

FIG. 6 is a drawing for describing the angular deviation of the intermediary transfer belt 31. FIG. 7 is a flowchart of the control sequence carried out in the startup mode in the first embodiment. FIG. 8 is a flowchart of the control sequence for tilting the driver roller in the startup mode in the first embodiment. FIG. 9 is a flowchart of the combination of the lateral belt shift control sequence and subsequent belt angle control sequence. FIG. 10 is a drawing for describing the speed with which the intermediary transfer belt 31 shifts in position in its widthwise direction during the startup period.

FIG. 6 is a combination of an extended schematic plan view of the belt unit 30 and the control system of the belt unit 30, and shows how the intermediary transfer belt 31 is controlled in position in terms of its widthwise direction. In FIG. 6, the portion of the intermediary transfer belt 31, which is between the steering roller 35 and the belt backing roller 36, and the portion of the intermediary transfer belt 31, which is between the belt back roller 36 and driver roller 34, are shown extended (developed) in the rotational direction of the belt 31.

Referring to FIG. 6, the steering roller 35, which is an example of the first steering roller, is on the downstream side of the first transfer surface 53, which is an example of an area in which the intermediary transfer belt 31 contacts the image bearing members. The first sensor 38*b* which is an example of the first detecting means detects the position of the intermediary transfer belt 31 in terms of the widthwise direction of the belt 31, in the adjacencies of the steering roller 35.

A lateral belt shift control portion 51, which is an example of the first controlling means, controls the steering roller 35 in the amount (angle) by which the roller 35 is to be tilted, based on the output of the first sensor 38*b*. More specifically, the lateral belt shift control portion 51 causes the intermediary transfer belt 31 to settle in a preset position in terms of the widthwise direction of the belt 31, by controlling the steering roller 35 during an image forming operation. That is, the lateral belt shift control portion 51 calculates the amount of the positional deviation of the intermediary transfer belt 31 in terms of the widthwise direction of the belt 31, based on the signals sent from the first sensor 38*b*, and controls the angle by which the steering roller 35 is to be tilted, by outputting control signals which reflect the calculated amount of the belt deviation.

The driver roller 34 which is an example of the second steering roller is positioned a preset distance away from the steering roller 35 in terms of the rotational direction of the intermediary transfer belt 31. The driver roller 34 also can adjust the intermediary transfer belt 31 in position in terms of the widthwise direction of the belt 31, by being tilted. The driver roller 34 is on the upstream side of the steering roller 35. More specifically, it is on the opposite side of the first transfer surface 53 from the steering roller 35. The second sensor 38*b* detects the position of the intermediary transfer belt 31 in terms of the widthwise direction of the belt 31, in the adjacencies of the driver roller 34.

A belt angle control portion 52 which is an example of the second controlling means controls the driver roller 34, based on the amount of difference between the output of the second sensor 38*a* which is an example of the second detecting means, and the output of the first sensor 38*b* which is an example of the first detecting means. The belt angle control portion 52 corrects the intermediary transfer belt 31 in angle by controlling the driver roller 34. More specifically, the belt angle control portion 52 calculates the amount of positional deviation of the intermediary transfer belt 31 in the widthwise direction of the belt 31, based on the detection signals sent from the second sensor 38*a*, and then, controls the driver roller 34 in angle by which the driver roller 34 is tilted, by outputting to the steering control motor 40, control signals which reflect the calculated amount of the positional deviation of the belt 31.

A control portion 10 is an example of a center value adjusting means. As the image forming apparatus (intermediary transfer belt 31) is started up, the control portion 10 sets the center value of the range of tilt of the steering roller 35 to the home position in angle for the steering roller 35, that is, the steering roller angle determined during the designing of the image forming apparatus 1, while reducing the intermediary transfer belt 31 in the amount of stress.

In the startup mode, the image forming apparatus 1 (intermediary transfer belt 31) is started up while the steering roller 35 and driver roller 34 are kept at the initial angles, that is, the same angles as those at which they were when the apparatus 1 was shipped out of a factory. As soon as the apparatus 1 is started, the intermediary transfer belt 31 is made to settle in position in terms of its widthwise direction, by controlling the steering roller 35. Then, the driver roller 34 is gradually tilted, while correcting the intermediary transfer belt 31 in position in terms of its widthwise direction by the steering roller 35, so that the center value of the range of tilt of the steering roller 35 matches again the initial value.

As the intermediary transfer belt 31 begins to be rotated, the control portion 10, which is an example of the center value adjusting means, repeats the center value adjustment control which controls the driver roller 34 to guide the center value of the range of tilt of the steering roller 35 back to the initial value, so that the image forming apparatus is reduced in the frequency with which it needs to be operated in the readjustment mode. The control portion 10 sets at least the referential value for determining the angle by which the development roller 34 is to be tilted to correct the intermediary transfer belt 31 in angle, or the referential value for determining the target position for the intermediary transfer belt 31, by operating the image forming apparatus 1 in the startup mode, which is one of the center value adjustment modes, during the starting up of the intermediary transfer belt 31, that is, an example of a period in which no image is formed.

Referring to FIG. 7 along with FIG. 6, in the startup mode, the angle of the steering roller 35 and the angle of the driver roller 34 are set to their initial angles, respectively, and then, the intermediary transfer belt 31 is started (S2). Then, the intermediary transfer belt 31 is made to settle in position in terms of its widthwise direction by controlling the steering roller 35 in angle while keeping the angle of the driver roller 34 at a preset value (S2).

Then, the driver roller 34 is controlled so that the center value of the range of the tilt of the steering roller 35, at which the intermediary transfer belt 31 becomes stable in position in its widthwise direction, is guided to a preset value (S3). That is, the center value of the range of the tilt of the steering roller 35 is moved to the preset value by gradually tilting the driver roller 34 while steering the intermediary transfer belt 31 by the steering roller 35 (S3).

The belt angle control portion 52 retains the amount of the inclination (angle) of the driver roller 34 which guided the center value of the inclination of the steering roller 35 to the preset value, and the value of the output (belt position in terms of belt width direction), and uses these values as the referential values for the belt angle control (S4).

To describe in more detail, the lateral belt shift control portion 51 reads the home position, in angle, for the steering roller 35, and the target belt position for the first sensor 38*b*, from the control portion 10, and sets the steering roller 35 to the home position in terms of its angle. The belt angle control portion 52 reads the home position for the driver roller 34 in terms of angle, from the control portion 10, and tilts the driver roller 34 to the home position (S1). These values (angles) are the values set during the designing of the image forming apparatus (belt unit). The home position for the steering roller 35 in terms of angle was set so that the speed with which the intermediary transfer belt 31 laterally shifts becomes zero, whereas the target belt position was set so that the center of the image formation area coincides with the center of the intermediary transfer belt 31 in terms of the widthwise direction of the belt 31. However, the method for setting these values (angle and position) does not need to be limited to the above described ones.

Next, the intermediary transfer belt 31 is rotated by the driver roller 34. The lateral belt shift control portion 51 calculates the amount (angle) by which the steering roller 35 is to be tilted, based on the amount of positional deviation of the intermediary transfer belt 31 in the belt width direction, which was obtained with the use of the first sensor 38*b*, and the target belt position read in Step S1. The lateral belt shift control portion 51 corrects the intermediary transfer belt 31 in position in terms of its widthwise direction, by tilting the steering roller 35 so that the belt 31 settles in the targeted belt position (S2).

As the intermediary transfer belt 31 becomes stable in position in Step S2, the steering roller 35 remains roughly stable in angle. Idealistically, the angle of the steering roller 35, at which the intermediary transfer belt 31 becomes stable in position in terms of its widthwise direction, roughly coincides with the home position, in terms of angle, for the steering roller 35, that is, the angle (value) read in Step S1 by the lateral belt shift control portion 51.

In reality, however, because of the effects of the deformation of the belt unit 30, degree of accuracy in the alignment of the rollers by which the intermediary transfer belt 31 is suspended, and/or the like factors, it is normal that the intermediary transfer belt 31 is subjected to such a force that works in the widthwise direction of the belt 31. Therefore, it is not unusual that the intermediary transfer belt 31 becomes stable in position in terms of its widthwise direction when the angle of the steering roller 35 is not the same as the home position.

Thus, the belt angle control portion 52 moves the center of inclination of the steering roller 35 to the home position, which was read in Step S1, by slowly tilting the driver roller 34, that is, at a speed (angular speed) which is equal to 2% of the maximum speed (angular speed) for the steering roller 35 (S3). While making the amount of inclination (angle) of the steering roller 35 quickly respond to the changes in the output of the first sensor 38*b*, the belt angle control portion 52 changes the driver roller 34 in angle at a speed which is slow enough not to make the steering control unstable. The details of the Step S3 will be described later with reference to FIG. 8.

As the value, in terms of angle, of the steering roller 35, which made the intermediary transfer belt stable in position in terms of its widthwise direction, becomes roughly equal to the home position for the steering roller 35, the belt angle control portion 52 sets the angle in which the driver roller 34 was at this point of time, as the home position for the driver roller 34 in terms of angle (S4). Here, the value of the angle in which the steering roller 35 was when the intermediary transfer belt 31 became stable in position is such a value that keeps the output of the first sensor 38*a* no higher than a preset value.

Thereafter, the belt position outputted from the second sensor 38*a* is monitored for a preset length of time while the driver roller 34 is kept tilted at the home position in angle set in Step S4. Then, the obtained belt positions are averaged. Then, the average belt position is used as the target belt position for the belt position detected by the second sensor 38*a* (S5). However, the target position for the belt may be obtained with the use of the method other than the above described one. For example, the median value of the belt positions detected for a preset length of time may be used as the target position for the intermediary transfer belt 31.

The two target positions for the intermediary transfer belt 31, which are obtained through the above described steps are such two positions that when the intermediary transfer belt 31 is in one of the two positions, it is in its most natural state, that is, it is smallest in the amount of energy attributable to its elasticity. Therefore, as long as the steering control is carried out so that the belt position is in the adjacencies of the target belt position obtained through the above described steps, the first transfer surface 53 remains minimum in the amount of deformation.

Next, referring to FIG. 10(*a*), which shows the idealistic relationship between the amount (x) of steering, which is the angle by which the steering roller 35 is tilted, and the speed (y) at which the intermediary transfer belt 31 is moved in its widthwise direction, if the relationship is idealistic, the intermediary transfer belt 31 does not move in its widthwise direction when the amount (x) of steering is zero. Therefore, as long as the steering control is carried out while the above-mentioned relationship is idealistic, the force which works on the intermediary transfer belt 31 in the widthwise direction of the belt 31 is erased while the amount (x) of steering is virtually zero where the belt 31 is not moved in its widthwise direction. Therefore, the steering control becomes stable.

In reality, however, it is not unusual that because of the errors which occurred during the assembly of the belt unit 30, the intermediary transfer belt 31 is moved in its widthwise direction at a speed y0 even if the amount of steering is zero, as shown in FIG. 10(*b*). That is, the curved line in FIG. 10(*b*) which shows the actual relationship between the amount (x) by which the steering roller 35 is tilted, and the speed (y) by which the intermediary transfer belt 31 is moved in its widthwise direction, is parallel to the curved line in FIG. 10(*a*) which shows the idealistic relationship between the amount (x) by which the steering roller 35 is tilted, and the speed (y) by which the intermediary transfer belt 31 is moved in its widthwise direction. Further, the former has a positive positional deviation of y0 in the direction of vertical axis Y relative to the latter.

Therefore, if the intermediary transfer belt 31 of such a belt unit 30 that the speed (y) with the intermediary transfer belt 31 moves in its widthwise direction is zero when the amount (x) of the steering of the steering roller 35 is steered, the intermediary transfer belt 31 becomes stable in position when the amount (x) of the steering is in the adjacencies of the amount (x1). Further, the smaller the distance between the two curved lines, that is, the smaller the speed (y0) with which the intermediary transfer belt 31 is moved in its widthwise direction, the closer the amount (x1) of the steering to the home position in terms of angle. Therefore, the relationship between the amount (x1) of steering and the speed (y0) with which the intermediary transfer belt 31 is moved in its widthwise direction can be expressed in the form of a monotone function.

Based on the above described facts, it is possible to qualitatively grasp the normal speed (y0) with which the intermediary transfer belt 31 laterally shifts, by detecting the amount (x1) of the steering by the steering roller 35 when the intermediary transfer belt 31 became stable in position in Step S2. If the amount of steering by the steering roller 35 is close to the home position in angle for the steering roller 35 when the intermediary transfer belt 31 became stable in position, the normal speed (y0) of the lateral shift of the intermediary transfer belt 31 is roughly zero.

FIG. 8 is a flowchart of the details of Step S3 in FIG. 7 which is the flowchart of the control sequence in the startup mode.

Referring to FIG. 8 along with FIG. 6, the control portion 10 reads the amount of inclination (angle) of the steering roller 35, which made the intermediary transfer belt 31 stable in position in its widthwise direction, and which was obtained in Step S2 (FIG. 7). Then, the control portion 10 calculates the absolute value of the difference between the read angle and the home position Xorg in angle (preset during designing of apparatus) for the steering roller 35, and compares the calculated absolute value with a preset referential value Xerr (for determining whether difference is permissible or not). If the calculated absolute value is smaller than the value Xerr (Yes in S311), the operation in the startup mode is ended.

If the absolute value of the difference is no less than the preset value Xerr (No in S311), the control portion 10 proceeds to the next step (S312).

Then, the control portion 10 determines whether the value of the amount of the difference between the detected amount of the steering Xstr and the home position Xorg in angle is positive or negative (S312). If the value is positive, the control portion 10 moves the driver roller 34 in steering position by a preset distance of ΔX (S313*a*). If the value is negative, the control portion 10 moves the driver roller 34 in steering position by a preset distance of −ΔX (S313*b*). Thus, the detected amount Xstr by which the steering roller 35 is tilted converges to the home position Xorg in angle. Although whether the direction in which the steering roller 35 is steered is position or negative depends on the definition of the system of coordinates, it is set so that the angle of the steering roller 35 converges toward the home position Xorg in angle.

After the completion of the above described sequence, the control portion 10 returns to Step S311, and repeats the sequence until the sequence shown in FIG. 7 ends.

Incidentally, in the startup mode in the first embodiment, the driver roller 34 is controlled to initialize the steering roller side. However, the driver roller 34 may be put back into the initial state by controlling the steering roller 35. In the case where the driver roller 34 is initialized, the initial steering position of the driver roller 34 and the target position for the second sensor 38*a* are read as preset values from the control portion 10 at the beginning of the startup mode.

After the completion of the operations in the startup mode shown in FIGS. 7 and 8, the normal steering control and belt angle correction control are carried out, following the flowchart in FIG. 9.

Figure 11:
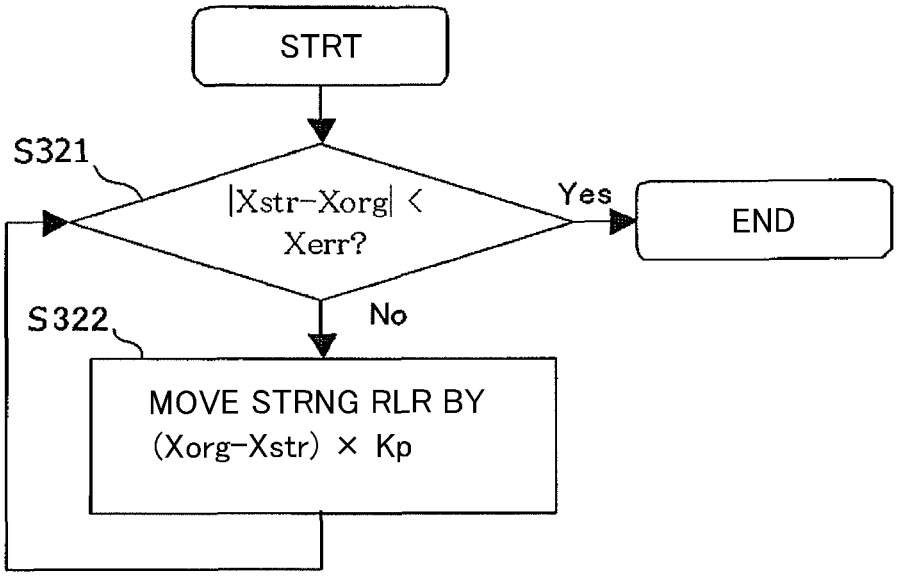
FIG. 11 is a flowchart of a control sequence for controlling the driver roller in angle, in the startup mode, in the second embodiment.

Next, referring to FIG. 11 along with FIG. 6, right after the completion of the initialization in the startup mode, the steering roller 35 is used to control the intermediary transfer belt 31 only in its lateral shift (S11). Then, if the intermediary transfer belt 31 is stable in rotation (Yes in S12), the belt angle control portion 52 carries out the control for correcting the intermediary transfer belt 31 in angle (S13). More specifically, based on the amount of lateral shift of the intermediary transfer belt 31 obtained based on the output of the second sensor 38*a*, and the target belt position obtained in Step S5 in FIG. 7, the belt angle control portion 52 calculates the angle (steering amount) by which the driver roller 34 needs to be tilted. Then, it tilts the driver roller 34 by the necessary angle, by activating the steering control motor 40 for a length of time proportional to the angle by which the driver roller 34 needs to be tilted.

Incidentally, in the first embodiment, the image forming apparatus 1 (intermediary transfer belt 31) is operated in the startup mode, each time it is started up. It is not mandatory that each time the apparatus (intermediary transfer belt 31) is started up, it is operated in the startup mode. For example, the belt angle control portion 52 may be provided with a memory so that the home position, in angle, of the driver roller 34 obtained when the apparatus was operated last time in the startup mode and the target belt position for the second sensor 38*a* can be stored, and may be reused. In such a case, as soon as the belt 31 begins to be rotated, the home position for the driver roller 34 and the target belt position for the second sensor 38*a* are read from the memory, and used for the normal steering control and the belt angle correction control.

Also in the first embodiment, the intermediary transfer belt 31 is indirectly corrected in angle by correcting the intermediary transfer belt 31 in position in its widthwise direction by the steering roller 35 and driver roller 34, at the positions of the rollers 35 and 34, respectively. However, the intermediary transfer belt 31 may be directly corrected in angle with the use of one of the two rollers 35 and 34. For example, the intermediary transfer belt 31 may be corrected in angle by tilting the steering roller 35 or driver roller 34 by an angle which is proportional to the amount of the difference between the lateral positional deviation of the intermediary transfer belt 31, which is detected by the first sensor 38*b*, and the amount of the lateral positional deviation of the intermediary transfer belt 31, which is detected by the second sensor 38*a*.

Also in the first embodiment, the belt position was accurately detected with the use of the patterns 55 in FIG. 3. However, an ordinary belt position detecting method, which detects the position of one of the lateral edges of the belt by placing its sensor in contact with the belt edge, may be employed, although this method is problematic in that because of the manufacture conditions, belt materials, and/or the like factors, the lateral edges of the intermediary transfer belt 31 are not straight, in the strict sensor of the words, and therefore, this method may not be able to accurately calculate the amount of angular deviation of the intermediary transfer belt 31.

Thus, in the case where the method which determines the position of the intermediary transfer belt 31 in its widthwise direction by directly detecting the position of one of the lateral edges of the intermediary transfer belt 31, the belt position can by accurately detected by making the two belt position sensors different in belt detection timing, or obtaining the profile of one of the lateral edges of the intermediary transfer belt 31 in advance and correcting the detected belt position based on the profile of the lateral edge. Such modifications can eliminate the effects of the profile of the lateral edges of the intermediary transfer belt 31, and therefore, make it possible to accurately detect the amount of angular deviation (amount of skewness) of the intermediary transfer belt 31. In particular, in the case of the latter modification, the various components of error can be eliminated by averaging the outputs of the multiple sensors (two in this embodiment), and therefore, the amount of lateral shift of the intermediary transfer belt 31 can be more reliably obtained.

The belt steering method in the first embodiment comprises the following three sections. In the first section, the intermediary transfer belt 31 is started up with the steering roller 35 and driver roller 34 being tilted at their home positions in angle. In the second section, the intermediary transfer belt 31 is stopped from laterally shifting, by the tilting of the steering roller 35. Then, while controlling the steering roller 35 in angle, the driver roller 34 is gradually tilted until the center value of the range of tilt of the steering roller 35 settles at the home position in angle. In the third section, the angle of the driver roller 34 at the moment when the center value of the range of the tilt of the steering roller 35 settled to the home position in angle is used as the new value for the home position in angle for the driver roller 34, and the intermediary transfer belt 31 is corrected in angle by the driver roller 34 using the new value.

The belt driving method described above makes it possible to properly set a belt driving apparatus, which can be simultaneously corrected in the positional and angular deviation of its endless belt, during the startup operation. That is, it makes it possible to form the first transfer surface 53, which is normal in shape, that is, free of deformation or the like. Therefore, it can prevent an image forming apparatus from outputting images which suffer from such problems as image disfiguration, which occurs during the first transfer. Further, it makes zero the normal amount of lateral shift of the intermediary transfer belt 31 while the apparatus is operated in the startup mode. Therefore, the control can be carried out within a range in which "plant" remains virtually linear.

<Embodiment 2>

FIG. 11 is a flowchart of the control sequence for tilting the driver roller 34 in the startup mode in the second embodiment. The second embodiment is the same as the first embodiment, except that the portion of the flowchart in the first embodiment, which is FIG. 8, is different from the portion of the flowchart in the second embodiment, which is FIG. 11. Thus, the control of the belt unit 30 in the second embodiment is similar to that in the first embodiment. Therefore, the second embodiment 2 is described only about the difference of the control sequence shown in FIG. 11 from that in FIG. 8; the portions of the second embodiment, which are the same as the counterparts of the first embodiment, are not going to be described.

Referring to FIG. 7 along with FIG. 6, in the second embodiment, the belt angle control portion 52 moves the intermediary transfer belt 31 in such a manner that the belt position detected by the first sensor 38*b* converges to the target belt position by the controlling of the snaking of the belt 31 by the controlling (tilting) of the steering roller 35 (S2). Then, the belt angle control portion 52 changes the driver roller 34 in the angle relative to the home position in angle for the driver roller 34 in such a manner that the center value of the range of the tilt of the steering roller 35 settles at the home position in angle for the steering roller 35 read in Step S1 (S3).

Next, referring to FIG. 11 along with FIG. 6, in the second embodiment, the angle of the steering roller 35 is detected as soon as the intermediary transfer belt 31 is made stable in position in its widthwise direction by the tilting of the steering roller 35; the angle Xstr of the steering roller 35 is obtained. Then, the amount of difference between the angle Xstr of the steering roller 35, and the home position Xorg in angle of the steering roller 35, which was obtained by the belt angle control portion 52, is calculated. Then, the absolute value of the calculated amount of difference is compared with the preset referential value Xerr (S321).

If the absolute value of the calculated amount of difference is no more than the preset referential value Xerr (Yes in S321), the belt angle control portion 52 ends the control sequence. If the absolute value of the calculated amount of difference is no less than the preset referential value Xerr (No in S321), the belt angle control portion 52 proceeds to the next step (S322).

The belt angle control portion 52 uses the following formula (1) to calculates the amount by which the driver roller 34 is to be moved, and moves the driver roller 34 by the calculated amount (S322).

$$(Xorg-Xstr)\times Kp \quad (1)$$

Here, Kp stands for the ratio of the amount by which the driver roller 34 is to be controlled, relative to the amount of feedback, that is, ratio of gain. Formula (1) is for calculating the amount by which the driver roller 34 is to be moved to control the intermediary transfer belt 31 in angle, that is, the amount (for steering intermediary transfer belt 31) which is proportional to the absolute value of the amount of difference between the home position Xorg in angle of the steering roller 35, and the angle Xstr of the steering roller 35 at which the steering roller 35 keeps the intermediary transfer belt 31 stable in position in terms of its widthwise direction. It is the mathematical formula for calculating the amount of movement of a given object proportional to the movement of another object in the field of the so-called controls engineering.

At the end of the above described section, the belt angle control portion 52 returns to Step S321 and repeats the same (S321 and S322) until the aforementioned absolute value becomes smaller than the preset referential value Xerr.

<Embodiment 3>

Figure 12:
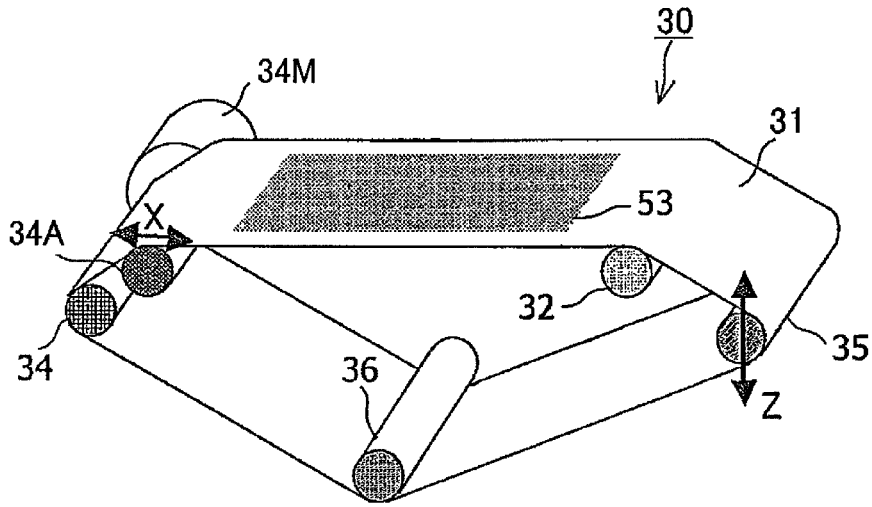
FIG. 12 is a schematic sectional view of the image forming apparatus in the third preferred embodiment of the present invention, and depicts the structure of the apparatus.

FIG. 12 is a schematic perspective view of the belt unit in the third embodiment of the present invention, and depicts the structure of the belt unit.

In the first embodiment, the intermediary transfer belt 31 is corrected in angle by tilting the driver roller 34. Unlike the belt unit in the first embodiment, in the case of the belt unit 30 in the third embodiment, the rotational shaft of the driver roller 34 which is rotated by the motor 34M is solidly attached to the frame of the belt unit 30. Therefore, the driver roller 34 cannot be tilted. Thus, the belt unit 30 in this embodiment is provided with a steering roller 34A, which is an example of the second steering roller. The steering roller 34*a* is between the first transfer surface 53 and driver roller 34.

The steering roller 34A can be tilted in the direction indicated by an arrow mark X to move the intermediary transfer belt 31 in the widthwise direction of the belt 31.

As will be evident from the detailed description of the embodiments of the present invention given above, according to the present invention, even if a belt unit having multiple steering rollers is not perfect in the positioning of the steering rollers, it is ensured that the steering rollers keep the belt minimum in the amount of unwanted lateral shift.

Incidentally, the above described image forming apparatuses in the embodiments of the present invention were structured so that toner images are formed on their intermediary transfer belts. However, the present invention is also applicable to an image forming apparatus structured so that its image forming portion forms toner images on a sheet of recording medium borne on its recording medium conveyance belt.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 037528/2010 filed Feb. 23, 2010 which is hereby incorporated by reference.

What is claimed is:

1. An image forming apparatus comprising:

a rotatable belt member;

an image forming station configured to form an image on said belt member or a recording material carried on said belt member in a region opposing said belt member;

a first and a second detecting member configured to detect position of said belt member with respect to a widthwise direction of said belt member;

a first and a second steering roller configured to correct the position of said belt member with respect to the widthwise direction by inclination;

a control portion configured to control an inclination of said first steering roller and said second steering roller on the basis of an output of at least one of said first detecting member and said second detecting member;

a first executing portion configured to execute, in a period other than an image formation period, an operation in a correction mode in which, in a state that said first steering roller is maintained at a first reference inclination, said control portion controls said second steering roller to correct a second reference inclination of said second steering roller; and a second executing portion configured to execute, in a period other than a period of the correction mode operation, an operation in a control mode in which said first steering roller is controlled on the basis of the first reference inclination, and said second steering roller is controlled on the basis of the second reference inclination.

2. The apparatus according to claim 1, wherein said first steering roller is disposed at one of an upstream side and a downstream side of said region with respect to a rotational moving direction of said belt member, and said second steering roller is disposed at the other of the upstream side and the downstream side.

3. The apparatus according to claim 1, wherein said first executing portion corrects the second reference inclination in a state that a position of said belt member in the widthwise direction as detected by said first detecting member is not outside a predetermined range.

4. The apparatus according to claim 1, further comprising a storing member configured to store the corrected second reference inclination obtained by the operation in the correction mode.

5. The apparatus according to claim 1, wherein said second steering roller is a driving roller configured to transmit a driving force to said belt member.

6. The apparatus according to claim 1, wherein the first reference inclination is an inclination of said first steering roller at a time when a moving speed of said belt member with respect to the widthwise direction is zero.

7. The apparatus according to claim 1, wherein the second reference inclination is an inclination of said second steering roller at a time when a moving speed of said belt member with respect to the widthwise direction is zero.

* * * * *